US006926644B2

(12) United States Patent
Chen

(10) Patent No.: US 6,926,644 B2
(45) Date of Patent: Aug. 9, 2005

(54) FOLDING EXERCISE TREADMILL WITH FRONT INCLINATION

(76) Inventor: James Chen, No. 35, Tun Hi Rd., Chin Chan Li, Sa Lu Chen, Taichung Hsien (TW)

( * ) Notice: Subject to any disclaimer, the term of this patent is extended or adjusted under 35 U.S.C. 154(b) by 0 days.

(21) Appl. No.: 10/809,900

(22) Filed: Mar. 26, 2004

(65) Prior Publication Data

US 2005/0096188 A1 May 5, 2005

(30) Foreign Application Priority Data

Oct. 29, 2003 (TW) ..... 92219228 U

(51) Int. Cl.[7] ..... A63B 22/02

(52) U.S. Cl. ..... 482/54

(58) Field of Search ..... 482/51, 54

(56) References Cited

U.S. PATENT DOCUMENTS

| | | | | |
|---|---|---|---|---|
| 5,860,893 | A * | 1/1999 | Watterson et al. | 482/54 |
| 6,419,612 | B1 * | 7/2002 | Yu | 482/54 |
| 6,638,200 | B2 * | 10/2003 | Chang | 482/54 |
| 6,746,374 | B2 * | 6/2004 | Chang | 482/54 |
| 6,746,376 | B2 * | 6/2004 | Chang | 482/54 |

* cited by examiner

*Primary Examiner*—Stephen R. Crow
(74) *Attorney, Agent, or Firm*—Browdy and Neimark, P.L.L.C.

(57) ABSTRACT

An exercise treadmill includes a base frame having first and second guiding slots in each of two lateral sides thereof, a treadmill frame, which has two locating rods respectively movably coupled to the second guiding slots and a shaft transversely disposed at a front side thereof and moveably coupled to the first sliding slots at two distal ends thereof, and a lifting device. The lifting device includes a motor and a transmission mechanism coupled to the motor and the shaft for moving the shaft along the first guiding slots and to further lift the front side or a rear side of the treadmill frame so as to further adjust the angle of inclination of the treadmill frame or to receive the treadmill frame in a non-operative position.

6 Claims, 4 Drawing Sheets

FOLDING EXERCISE TREADMILL WITH FRONT INCLINATION

BACKGROUND OF THE INVENTION

1. Field of the Invention

The present invention relates to an exercise treadmill and more particularly, to an exercise treadmill having a fold-up capability and a front that is adjustable in the vertical direction.

2. Description of the Related Art

A conventional exercise treadmill essentially includes a base frame and a treadmill frame. The base frame is placed on the floor, having an upright upwardly extended from the front side for holding by the user walking on the treadmill belt of the treadmill frame. In order to simulate walking on a slope, the treadmill frame is provided with a locating hole on the front side for connection to one of a vertical row of locating holes at the front side of the base frame selectively by a lock pin. After use, the user can lift the rear side of the treadmill frame and receive the treadmill frame to the upright of the base frame to reduce space occupation.

This manual design is suitable for a small scale exercise treadmill, not practical for use in a big scale exercise treadmill. When received in the non-operative position, an additional lock device is necessary to lock the treadmill frame in the received position. A mistake during operation may cause the treadmill frame to fall, resulting in an accident.

SUMMARY OF THE INVENTION

It is the primary objective of the present invention to provide an exercise treadmill, which enables the treadmill frame to be received in the non-operative position or adjusted to the desired angle of inclination by means of an electric control.

It is another objective of the present invention to provide an exercise treadmill, which provides a self-locking function during turning of the treadmill frame, ensuring a safety use.

To achieve these objectives of the present invention, the exercise treadmill provided by the present invention comprises a base frame, a treadmill frame and a lifting device. The base frame has a front side and left and right sides each having a first guiding slot and a second guiding slot. The first guiding slot has an upper section substantially extending vertically and a lower section backwardly extended from a bottom side of the upper section. The second guiding slot substantially extends vertically and is disposed behind the upper section of the first guiding slot. The treadmill frame is pivotally movably mounted on the base frame, having a shaft transversely pivotally fastened to a front side thereof, two locating rods symmetrically coaxially disposed at two opposite lateral sides thereof and respectively coupled to and movable along the second guiding slots of the base frame, and two coupling members respectively provided at two distal ends of the shaft and engaged with the first guiding slots of the base frame and movable along the first guiding slots of the base frame upon rotary motion of the shaft. The lifting device is mounted in the treadmill frame, having a motor, and a transmission mechanism coupled between the motor and the shaft of the treadmill frame for rotating the shaft and the coupling members upon operation of the motor for enabling the front side of said treadmill frame to be lifted upon movement of the coupling members in the upper sections of the first guiding slots of the base frame, and for enabling a rear side of the treadmill frame to be lifted and turned about the locating rods during operation of the motor while the coupling members is moved to the lower sections of the first guiding slots of the base frame.

DETAILED DESCRIPTION OF THE INVENTION

Figure 1:
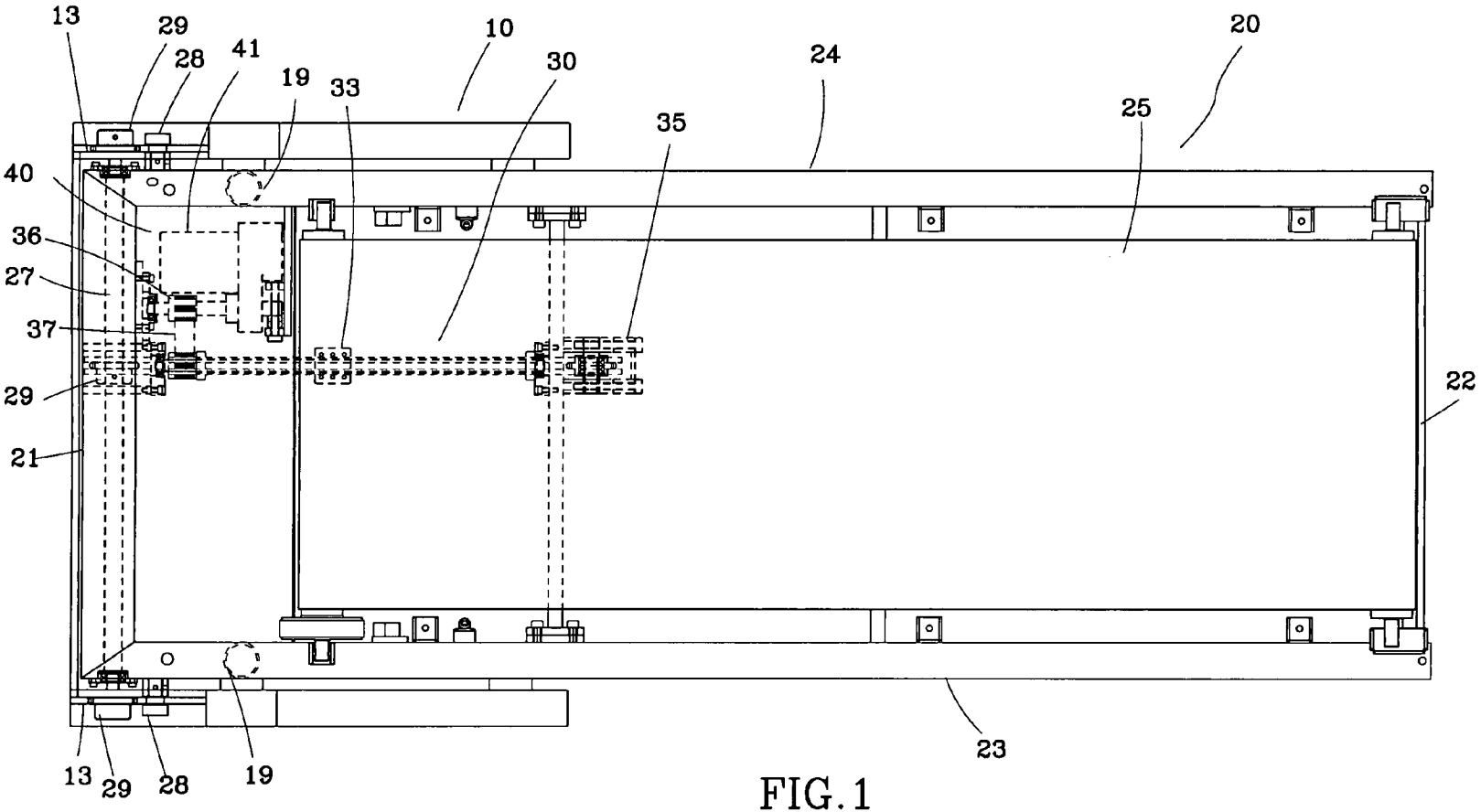
FIG. 1 is a top view of an exercise treadmill according to the present invention.
Figure 2:
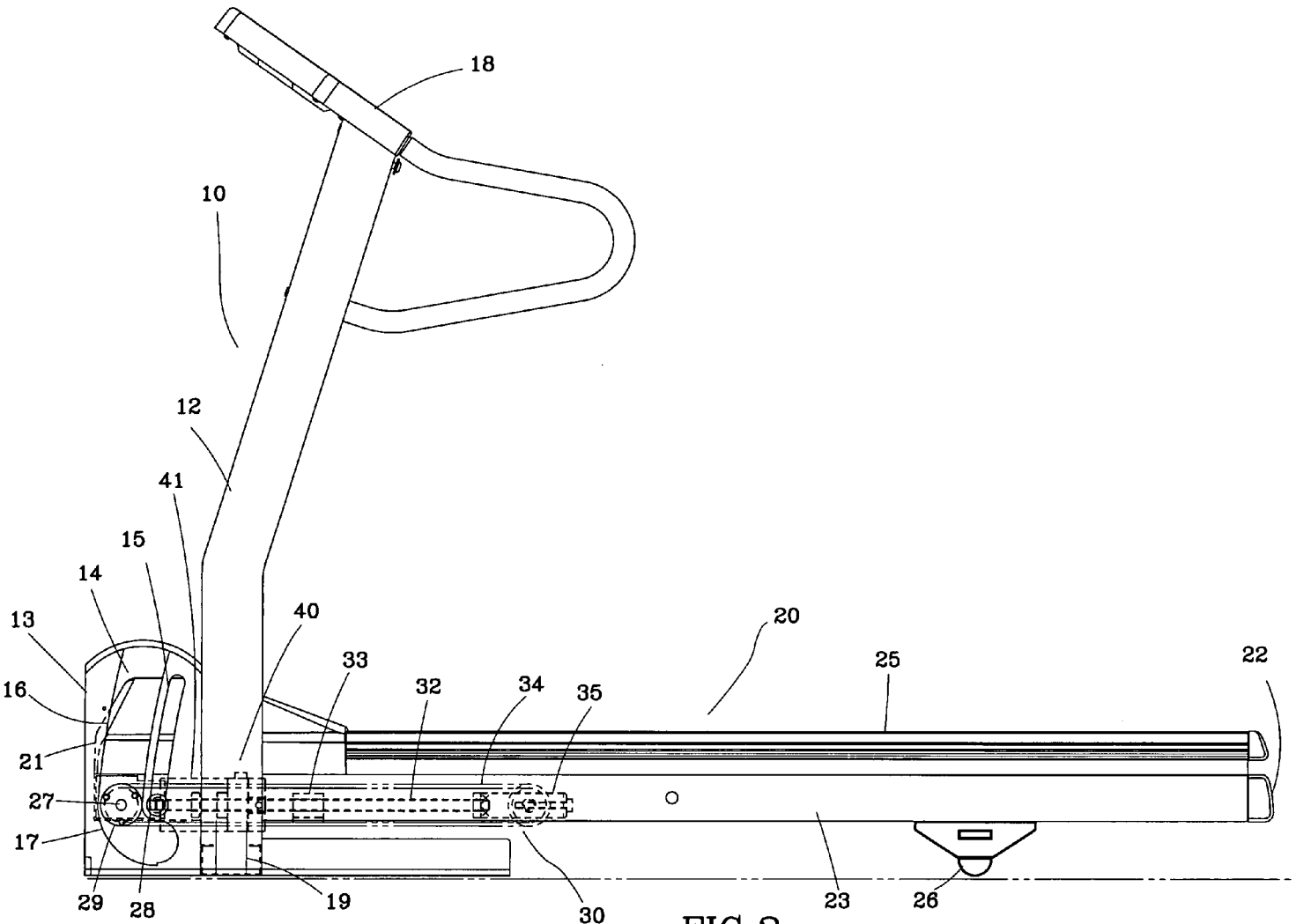
FIG. 2 is a left side view of the present invention showing the treadmill frame set in horizontal.

As shown in FIGS. 1 and 2, an exercise treadmill provided by a preferred embodiment of the present invention is shown comprised of a base frame 10, a treadmill frame 20, and a lifting device 40 mounted in the treadmill frame 20.

The base frame 10 is a rectangular open frame formed of metal rod members by welding for placing on the floor. The base frame 10 comprises an upright 12 upwardly extended from the top near the front side for holding by the user operating the exercise treadmill, a control panel 18 mounted on the upright 12, and two upright sidewalls 13 bilaterally longitudinally disposed at the front left and right sides. The sidewalls 13 each have a first guiding slot 14 and a second guiding slot 15. The first guiding slot 14 includes an upwardly extended upper section 16, and a lower section 17 backwardly extended from the bottom end of the upper section 16. A chain (not shown) is respectively provided at an inner side of the first guiding slot 14 in each upright sidewall 13. The second slot 15 extends upwards and disposed behind the upper section 16 of the first guiding slot 14. Two (or more) compression springs 19 are mounted in the base frame 10. The compression springs 19 each have a bottom end affixed to the bottom side of the base frame 10 and a top end extended upwards and connected to the treadmill frame 20, thereby imparting an upward pressure to the treadmill frame 20.

The treadmill frame 20 is mounted on the base frame 10, having a front side 21, a rear side 22, a left side 23, and a right side 24. A walking belt 25 is located between the left side 23 and the right side 24 on which the user walks. A foot member 26 is provided at the bottom of the rear side 22 for supporting the rear side of the treadmill frame 20 on the floor. A shaft 27 is fastened pivotally with the front side 21 of the treadmill frame 20 and transversely extended out of the left side 23 and the right side 24. Two locating rods 28 are respectively affixed to the left side 23 and the right side 24 and disposed behind the shaft 27. Coupling members 29, for example chain wheels, are respectively fastened to the middle part and two distal ends of the shaft 27. The two chain wheels 29 at the two distal ends of the shaft 27 are respectively meshed with the chains in the first guiding slots 14 of the base frame 10, and can be controlled to move along the first guiding slots 14. The two locating rods 28 are respectively coupled to the second guiding slots 15 in the two upright sidewalls 13 of the base frame 10. During rotary motion of the shaft 27, the chain wheels 29 are moved along the first guiding slots 14, and the locating rods 28 are moved along the second guiding slots 15.

The lifting device 40 comprises a motor 41 and a transmission mechanism 30 driven by the motor 41. The transmission mechanism 30 is comprised of a screw rod 32, a sliding block 33, and a chain 34. The screw rod 32 is rotatable on its own axis and perpendicularly aimed at the middle part of the shaft 27. The sliding block 33 is threaded onto the screw rod 32. The chain 34 is mounted on the chain wheel 29 at the middle part of the shaft 27 and a coupling member, for example, a chain wheel 35 at the rear side of the screw rod 32. The chain 34 has a lower portion meshed with the sliding block 33. The motor 41 has an output shaft 36 coupled to the front end of the screw rod 32 by a belt 37. Starting the motor 41 causes the screw rod 32 to rotate. During rotary motion of the screw rod 32, the sliding block 33 is forced to move along the screw rod 32, thereby causing the chain 34 to rotate the chain wheels 29 and the shaft 27. By means of the above design, the output power of the motor 41 is transmitted to the shaft 27 through a speed reduction and power multiplying action, thereby causing the chain wheels 29 at the two ends of the shaft 27 to move along the first guiding slots 14.

Figure 3:
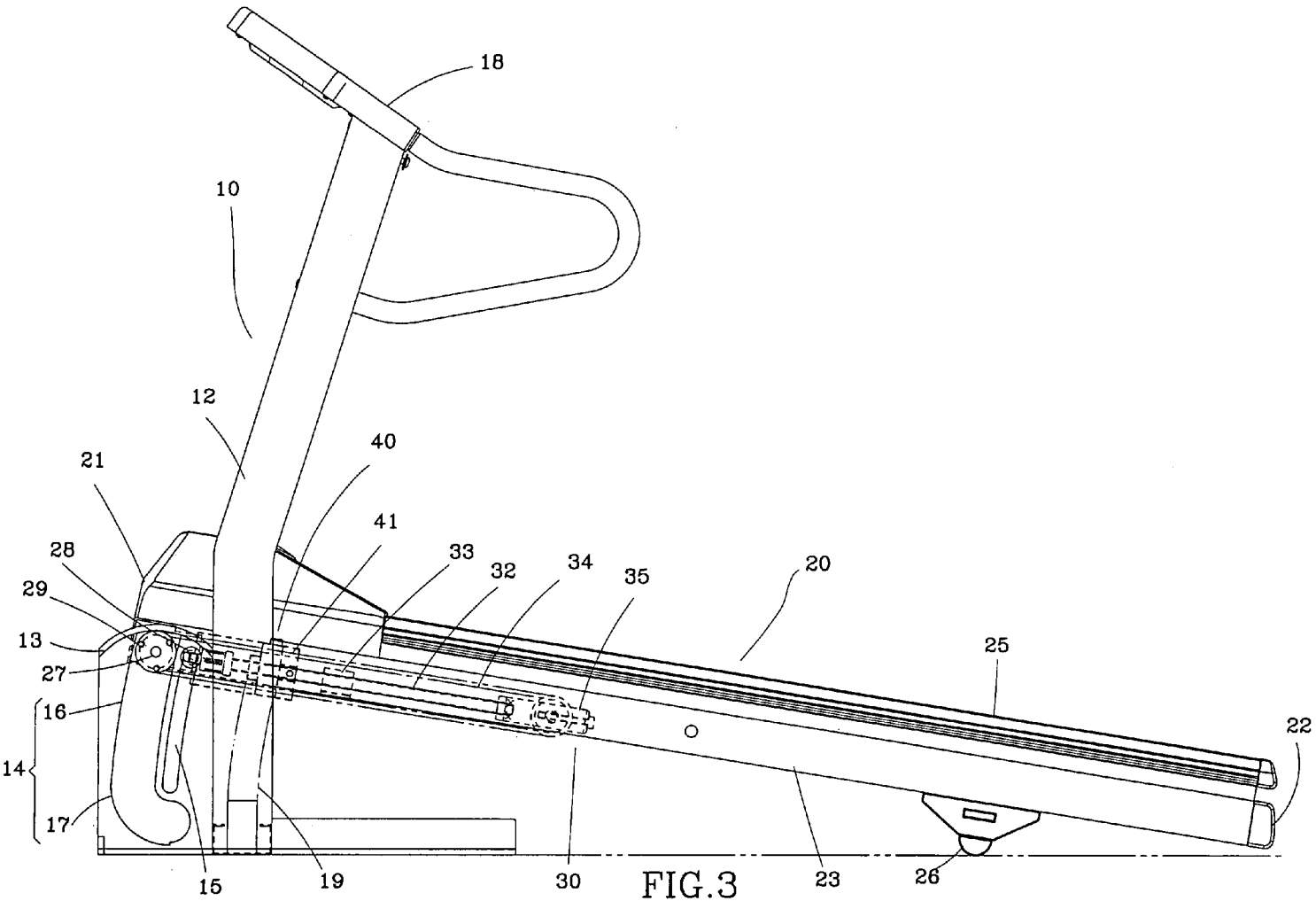
FIG. 3 is similar to FIG. 2 but showing the treadmill frame lifted.

As shown in FIGS. 2 and 3, when wishing to increase the angle of inclination of the treadmill frame 20, operate the control panel 18 to rotate the output shaft 36 of the motor 41 of the lifting device 40 clockwise (viewed from the front side of the treadmill frame 20), causing the belt 37 to rotate the screw rod 32 in clockwise direction. At this time, the sliding block 33 is moved along the screw rod 32 toward the rear side 22 of the treadmill frame 20 to turn the chain 34 in counter-clockwise direction (viewed from the left side of the treadmill frame 20). During counter-clockwise rotation of the chain 34, the shaft 27 is rotated counter-clockwise, thereby causing the chain wheels 29 at the two distal ends of the shaft 27 to move upwards along the upper sections 16 of the first guiding slots 14 and the locating rods 28 to move upwards along the second guiding slots 15, and therefore the treadmill frame 20 is turned about an axis passing through the foot member 26 and the front side 21 of the treadmill frame 20 is lifted from the base frame 10. When wishing to reduce the angle of inclination of the treadmill frame 20, operate the control panel 18 to rotate the output shaft 36 of the motor 41 of the lifting device 40 in counter-clockwise direction and to further rotate the chain 34 in clockwise direction. During clockwise rotation of the chain 34, the shaft 27 is rotated clockwise to move the chain wheels 29 at the two distal ends of the shaft 27 downwards along the upper sections 16 of the first guiding slots 14, and therefore the front side 21 of the treadmill frame 20 is lowered.

Figure 4:
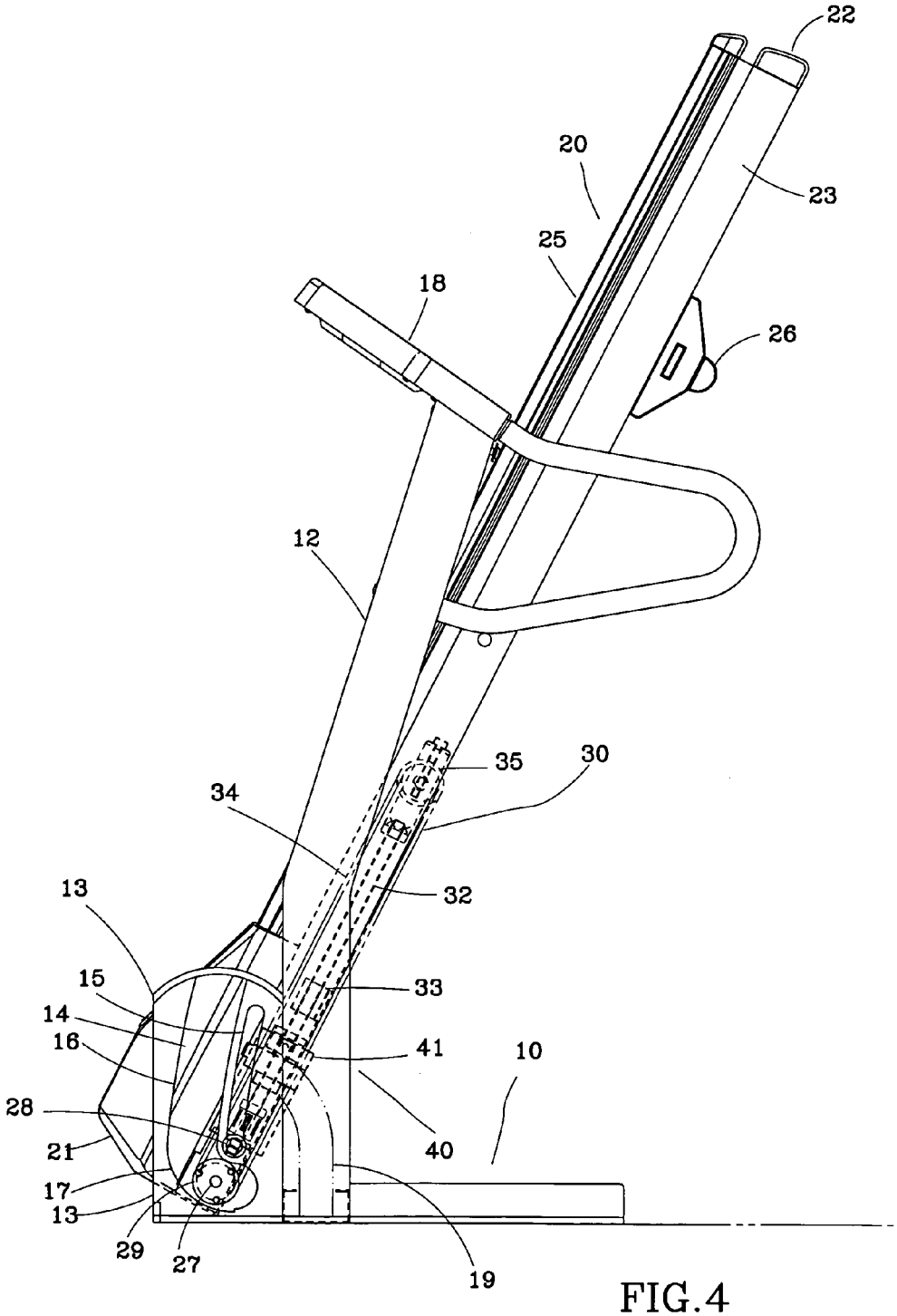
FIG. 4 is a left side view of the present invention showing the received status of the exercise treadmill.

As shown in FIG. 4, when wishing to receive the treadmill frame 20, operate the control panel 18 to rotate the output shaft 36 of the motor 41 of the lifting device 40 in counter-clockwise direction and to further rotate the chain 34 in clockwise direction. When continuously rotating the chain 34 in clockwise direction to drive the shaft 27 to rotate in clockwise direction, the two chain wheels 29 at the two distal ends of the shaft 27 are moved from the upper sections 16 of the first guiding slots 14 toward the corresponding lower sections 17. When the two chain wheels 29 at the two distal ends of the shaft 27 moved to the corresponding lower sections 17, the two locating rods 28 are respectively stopped at the bottom of the second guiding slots, thereby causing the treadmill frame 20 to be turned about an axis passing through the locating rods 28, and therefore the rear side 22 of the treadmill frame 20 is lifted from the floor and received to the upright 12. Because the sliding block 33 is coupled to the output shaft 36 through the screw rod 32, the output shaft 36 can drive the sliding block 33 to move along the screw rod 32; however the sliding block 33 cannot drive the output shaft 36 to rotate. This one-way self-locking function prevents falling of the treadmill frame 20 during lifting or receiving operation.

By means of the aforesaid design, the exercise treadmill can be electrically controlled to adjust the angle of inclination and automatically received in the non-operative position.

Further, gear and rack coupling means or ratchet coupling means may be used to substitute for the chain and chain wheel engagement structure between the coupling members of the two distal ends of the shaft and the first guiding slots of the base frame.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An exercise treadmill comprising:

a base frame for supporting on a floor, said base frame having a front side, a rear side, and left and right sides each having a first guiding slot and a second guiding slot, said first guiding slot having an upper section substantially extending vertically and a lower section backwardly extended from a bottom side of said upper section, said second guiding slot substantially extending vertically and disposed behind the upper section of the first guiding slot;

a treadmill frame pivotally movably mounted on said base frame, said treadmill frame having a shaft transversely pivotally fastened to a front side thereof, two locating rods symmetrically disposed at two opposite lateral sides thereof and respectively coupled to and movable along the second guiding slots of said base frame, and two coupling members respectively provided at two distal ends of said shaft and engaged with the first guiding slots of said base frame and movable along the first guiding slots of said base frame upon rotary motion of said shaft; and a lifting device mounted in said treadmill frame, said lifting device having a motor, and a transmission mechanism coupled between said motor and the shaft of said treadmill frame for rotating said shaft and said coupling members upon operation of said motor for enabling the front side of said treadmill frame to be lifted upon movement of said coupling members in the upper sections of the first guiding slots of said base frame, and for enabling a rear side of said treadmill frame to be lifted and turned about said locating rods during operation of said motor while said coupling members is moved to the lower sections of the first guiding slots of said base frame.

2. The exercise treadmill as claimed in claim 1, wherein said transmission mechanism comprises a screw rod rotatably connected to said motor, a sliding block threaded onto said screw rod and movable along said screw rod upon rotary motion of said screw rod, and a chain coupled between said shaft and said sliding block for rotating said shaft upon movement of said sliding block along said screw rod.

3. The exercise treadmill as claimed in claim 1, wherein said coupling members are chain wheels respectively meshed with a respective chain disposed in the first guiding slot of said base frame.

4. The exercise treadmill as claimed in claim 1, wherein said coupling members are gears respectively meshed with a respective rack disposed in the first guiding slot of said base frame.

5. The exercise treadmill as claimed in claim 1, wherein said coupling members are ratchet wheels respectively meshed with a respective toothed means disposed in the first guiding slot of said base frame.

6. The exercise treadmill as claimed in claim 1, further comprising a plurality of spring members coupled between said base frame and said treadmill frame for imparting an upward push force to said treadmill frame.

* * * * *